US010681960B2

(12) United States Patent
Leiber

(10) Patent No.: US 10,681,960 B2
(45) Date of Patent: Jun. 16, 2020

(54) INTERCHANGABLE SHOE HEEL

(71) Applicant: Katrin Leiber, Nußloch (DE)

(72) Inventor: Katrin Leiber, Nußloch (DE)

( * ) Notice: Subject to any disclaimer, the term of this patent is extended or adjusted under 35 U.S.C. 154(b) by 0 days.

(21) Appl. No.: 15/538,917

(22) PCT Filed: Dec. 4, 2015

(86) PCT No.: PCT/EP2015/078660
§ 371 (c)(1),
(2) Date: Jun. 22, 2017

(87) PCT Pub. No.: WO2016/102173
PCT Pub. Date: Jun. 30, 2016

(65) Prior Publication Data

US 2017/0347751 A1 Dec. 7, 2017

(30) Foreign Application Priority Data

Dec. 23, 2014 (DE) ..... 10 2014 119 561

(51) Int. Cl.
*A43B 21/48* (2006.01)
*A43B 21/42* (2006.01)
(Continued)

(52) U.S. Cl.
CPC ..... *A43B 21/42* (2013.01); *A43B 21/47* (2013.01); *A43B 21/48* (2013.01); *A43B 21/50* (2013.01); *A43B 21/51* (2013.01)

(58) Field of Classification Search
CPC ..... A43B 21/47; A43B 21/48; A43B 21/52; A43B 21/42; A43B 21/36
(Continued)

(56) References Cited

U.S. PATENT DOCUMENTS 333,612 A * 1/1886 Davis ..... A43B 13/34 36/41
1,344,356 A * 6/1920 Sahr ..... A43B 13/34 36/40
(Continued)

FOREIGN PATENT DOCUMENTS

AT 505748 B1 4/2009
CH 401749 A 10/1965
(Continued)

OTHER PUBLICATIONS

Int'l Search Report dated Feb. 11, 2016 in Int'l Application No. PCT/EP2015/078660.
(Continued)

*Primary Examiner* — Marie D Bays
(74) *Attorney, Agent, or Firm* — Panitch Schwarze Belisario & Nadel LLP

(57) ABSTRACT

An interchangeable shoe heel for a shoe having a shoe body with a heel part, the heel part having a metal rod extending over at least half the length of the shoe heel, and connected to the heel part, the rod protruding with its free end from the heel part. The shoe heel has a first part having an upper recess into which the rod engages with its free end and/or the heel part. The upper recess has a support surface, e.g., a collar or base wall, on its inner wall, on which the rod or a support area of the heel part is supported in the axial direction of the rod. A heel tip is arranged on the lower end of the first part, and the first part is covered by and connected to an encasing wall, extending from the heel tip up to the shoe body.

19 Claims, 4 Drawing Sheets

(51) Int. Cl.
*A43B 21/50* (2006.01)
*A43B 21/51* (2006.01)
*A43B 21/47* (2006.01)

(58) Field of Classification Search
USPC ..... 36/36 R, 36 A, 36 B, 36 C, 41, 42
See application file for complete search history.

(56) References Cited

U.S. PATENT DOCUMENTS 1,959,721 A * 5/1934 Kohler ..... A43B 21/30 36/42
2,263,186 A * 11/1941 Parkhurst ..... A43B 21/42 36/36 R
2,495,820 A * 1/1950 Peretti ..... A43B 21/46 36/34 R
2,799,098 A * 7/1957 Darvie ..... A43B 21/36 36/34 A
2,879,610 A 3/1959 Di Gaetano
3,514,879 A 6/1970 Frattallone
4,805,320 A * 2/1989 Goldenberg ..... A43B 1/0054 36/36 R
5,133,138 A * 7/1992 Durcho ..... A43B 1/0054 36/100
5,524,365 A * 6/1996 Goldenberg ..... A43B 3/24 36/36 C
6,023,858 A * 2/2000 Srourian ..... A43B 3/24 36/11.5
7,185,448 B2 * 3/2007 Schupbach ..... A43B 3/24 36/100
8,925,218 B2 * 1/2015 Anderson ..... A43B 21/42 36/100
2008/0034620 A1 * 2/2008 Gallegos ..... A43B 13/37 36/36 R
2008/0244931 A1 * 10/2008 Gallegos ..... A43B 1/0081 36/100
2016/0198795 A1 * 7/2016 Lopez-Velasquez ..... A43B 21/42 36/100
2017/0156441 A1 * 6/2017 Ho ..... A43B 21/46

FOREIGN PATENT DOCUMENTS

DE 595977 C 4/1934
DE 1890545 U 4/1964
DE 1896009 U 7/1964
DE 1485697 A1 3/1969
DE 202011101570 U1 4/2012
DE 202012101281 U1 5/2012
DE 202012103401 U1 10/2012
DE 102011103575 A1 12/2012
WO 2014023784 A1 2/2014

OTHER PUBLICATIONS

Search Report dated Nov. 24, 2015 in DE Application No. 1020141195612.
Int'l Preliminary Report on Patentability dated Jun. 27, 2017 in Int'l Application No. PCT/EP2015/078660.

* cited by examiner

INTERCHANGABLE SHOE HEEL

CROSS-REFERENCE TO RELATED APPLICATIONS

This application is a Section 371 U.S. National Stage Filing of International Application No. PCT/EP2015/078660, filed Dec. 4, 2015, which was published in the German language on Jun. 30, 2016, under International Publication No. WO 2016/102173 A1, which claims priority to German Patent Application No. 10 2014 119 561.2, filed on Dec. 23, 2014, the disclosures of which are incorporated herein by reference.

The invention relates to an interchangeable shoe heel for a shoe which has a shoe body on which a heel part is moulded or attached, and the heel part has a metal rod, which extends over at least two thirds of the length of the shoe heel and is connected with the heel part, particularly cast or stuck into the heel part, wherein the rod protrudes with its free end from the heel part.

Prior Art

Shoes, particularly ladies' shoes, often have a small area shoe heel tip or heel lift as their contact surface. This is subject to wear and therefore has to be replaced every so often. Special ladies' shoes are often also damaged in the area of the heel stem so that the entire heel has to be replaced. For this the shoemaker uses special tools and clamping devices.

The shoe heel is subject to high loads from various directions. The shoe heel tip, like the heel as a whole, must be twist-resistant so that particularly when resting on an edge, it does not twist. It must also withstand axial forces, since in a gap or on soft ground, corresponding forces act on the shoe heel tip or heel.

Ladies' shoes are often also subject to damage to the heel from scratches due to contact with other objects, such as steps or the edges of kerbs. It is also desirable to use various heel designs with the same shoe upper. In both cases the heel should be interchangeable. Here it is necessary to consider that for fashion reasons the shape of the heel tip or the cross-section of the heel varies greatly, e.g. from round or rectangular to square with highly-rounded edges.

A number of attempts have been made at solving these problems. Regarding the attachment of the shoe heel tip in practice principally one idea—according to DE 1485697—has caught on, where the shoe heel tip is fitted with a kind of dowel. Securing is generally performed by the shoemaker by pressing the shoe heel tip with dowel into an appropriately formed hole in the heel or rather pulling it out again with a device. It thus withstands both a torque and an axial load. Solutions with detents are also known—DE 2923928, AT 505748B1, DE 1896009U and DE 1890545U—in which a suitable release element acting radially brings about the unlatching. Such a detent mechanism is complex and not user-friendly.

In a solution according to DE 595977 (from 1936), by means of a radial screw the shoe heel tip is clamped tight in an inclined plane.

Regarding the attachment of the heel to the shoe body, there are solutions with a thread on the heel which is screwed into the shoe. The problem here is the abovementioned torque load, which the thread cannot withstand and remains twist-resistant even with right-/left-hand threads. The reason for this is that the shoe heel tip usually touches down either on the left or the right edge. So, varying torques result that lead to loosening of the tightened screw connection.

In German patent application DE 10 2011 103 575 from the applicant an interchangeable shoe heel or heel lift has previously been proposed, with a screwing device, having at least one retaining device, provided particularly with a device to prevent unintentional loosening, in order in this way to provide a shoe heel, particularly with an interchangeable heel lift, which can be changed straightforwardly and economically using simple tools and no jigs. This solution already has numerous advantages over the prior art.

In utility model application DE 20 2011 101 570 from the applicant the heel has a sleeve, wherein on the heel lift a pin is arranged, protruding into a sleeve and connected with this particularly by means of a compression joint.

In utility model application DE 20 2012 101 281 from the applicant, in the core part a retaining element is arranged, with which a further retaining element, arranged on the interchangeable heel part is connected, and attached to the heel tip. With this solution an easily interchangeable heel tip and heel are provided, wherein existing or new heel tips can be exchanged without the help of a shoemaker and wherein by simple means a further improved stability, particularly to combat bending can be achieved. Due to the attachment elements, the heel body surrounding these has practically no further supporting function. This allows great freedom of design of the heel form. Furthermore, light and economical materials can be used.

Although the above solutions have numerous advantages and particularly ensure a reliable but nevertheless easily detachable connection between heel and shoe body; it is sometimes desired to make the connection even simpler and particularly quicker to release or create, allowing rapid exchange if, for example, a number of different heels are to be tested.

In German utility model application DE 20 2012 103 401.8 from the applicant, a simple and rapid solution was provided by means of a detent connection, particularly a leaf spring, attached to the shoe body or a heel part firmly attached to the shoe body. In the embodiments presented the detent devices are arranged on the inside of the heel for practical purposes.

The outer contour of the heel part (core part) is matched with the inner contour of the detachable heel part (sleeve). The heel part has a relatively thin wall, so that the core part has sufficient strength. With the solution known from DE 20 2012 103401.8, however, it is only possible to use a single heel form.

The heel part (sleeve) is also provided with an encasing collar, with which it abuts the lower boundary of the first heel part (core). The interchangeable heel part (sleeve) does not extend as far as the sole.

OBJECT OF THE INVENTION

The object of the invention is to provide an interchangeable shoe heel, that can be easily exchanged and also have a wide variety of designs.

Achievement of the Object:

The object may be achieved by an interchangeable shoe heel with features as recited in the various claims.

The first part is advantageously configured such that it passes the external forces acting on the heel tip into the heel part, and the encasing wall serves merely for attaching the interchangeable heel to the shoe body or heel part. The encasing wall therefore does not have to absorb any bending forces.

The encasing wall and the first part can be configured as separate parts, which following manufacture are attached, particularly glued, to each other. Here the encasing wall can be advantageously made from a material, particularly plastic, with a constant wall thickness, resulting in a uniform surface, which is particularly important for the surface finishing, particularly chromium plating.

It is also possible, however, for the first part and the encasing wall to be moulded to one another, wherein the encasing wall then extends from the first part upwards and encases the heel part. Here the wall can at least in part abut the surface of the heel part. It is also possible, however, for the inner wall of the encasing wall to be partly spaced apart from the surface of the heel part.

So that the heel part attached to the shoe body is completely encased by the encasing wall, once the interchangeable shoe heel has been attached to the shoe body it is no longer visible. The entire heel length from the heel tip as far as the sole can therefore be freely designed and decorated. The heel part therefore no longer has to have additional lacquer applied.

The metal rod enclosed in the heel part, particularly cast or stuck, is enclosed at least partly with its lower end in the first part of the interchangeable shoe heel. Advantageously, the lower end of the metal rod can also protrude downwards from the heel part.

To reinforce the interchangeable shoe heel a metal sleeve can be incorporated, particularly injection-moulded, cast or stuck into the first part, into which the lower end of the metal rod protrudes, particularly being enclosed with a flush and form fit. Advantageously, the heel part can rest with its lower face on the upper face of the sleeve. The heel tip can also be inserted in the sleeve opening in the lower face and rest with its collar on the lower face of the sleeve. In this way the forces are transferred optimally from the heel tip to the sleeve and from this to the metal rod and the heel part, so that the material of the first part and the material of the encasing wall of the interchangeable shoe heel are only subject to minimal stress.

The heel part with the injection-moulded or stuck metal rod can advantageously account for at least ⅔ of the total length of the heel as a whole and is firmly connected to the shoe body.

If the interchangeable shoe heel can be produced by means of a 3D printing method, the outer sleeve and inner sleeve can be comprised a part with a recess for a sleeve or recess for the metal rod or the heel part. The production of parts by means of 3D printing currently still take a very long time and requires a lot of post-processing time. The material also changes over time meaning that in some cases it is not yet suitable for large runs.

Where no metal sleeve is used, the first part must comprise a high-strength material, particularly glass-fibre-reinforced plastic or metal. This involves both narrow heels, and those with a medium to large area. With narrow heels having a small heel tip or heel patch a metal inner sleeve is preferred.

Where a metal sleeve is provided for in the interchangeable shoe heel, this is advantageously made from brass, so that when the shoe is worn no squeaking sounds are produced.

The use of an encasing wall and of the first part as two separately produced parts is advantageous, since due to simple tooling the parts can be economically manufactured.

With narrow heels, it is sufficient if the first part merely encloses the free lower end of the metal rod protruding from the heel part, since there is little play with the heel part. In medium to large area heels the height of the first part is less than half the length of the heel. The heel part is extended by the first part and the heel tip to the total length of the interchangeable heel.

The interchangeable shoe heel is attached by particular attachment means to the heel part and/or to the shoe body, particularly the rear end of the shoe body. It is therefore possible for at least one snap-on connection to be provided, by means of which the encasing wall can be connected to the heel part. The snap-on element can advantageously have the form of a sphere or hemisphere, which engages in a, particularly window-like, recess of the encasing wall and thus creates a form fit which prevents the interchangeable shoe heel, from being detachable in the axial longitudinal direction of the metal rod from the heel part.

It is similarly also advantageously possible for the encasing wall to be directly connectable with the shoe body. This connection can likewise be configured as a snap-on connection. It is also possible, however, if to secure this connection, a screw or clasp means is provided, to ensure that the connection does not open unintentionally or due to excess forces.

This connection can thus be advantageously arranged on the heel counter of the shoe body, since this part is reinforced by a board-like material.

Through the positioning of this locking connection on the lower end of the heel counter of the shoe body and of the interchangeable heel part, the heel part can advantageously be easily detached.

The at least one snap-on connection with snap fastener or sliding part can be advantageously arranged on the inside, outside of, or laterally to, the heel part. These snap-on connections can have hollow, movable elements, wherein these are pre-tensioned by a spring, so that they are outwardly pressurised and thus through the spring force snap into the corresponding recess of the encasing wall. Here at least the spring of the snap-on connection is advantageously arranged in a recess or a cavity of the heel part, whereby advantageously only a small installation space in the heel part is needed.

The heel part can also comprise plastic or metal.

The connection means, particularly the snap fastener of the snap-on connection or the sliding element can advantageously be provided with a logo and/or for example decorated with strass stones or other elements.

Advantageously the parts necessary for the snap-on connection can be replaced. Thus, it is possible to secure the snap fastener with a plate, screwed onto the heel part, against being lost, so that only the plate has to be unscrewed in order to replace the snap fastener, should this be damaged or worn. With the snap-on connections shown the springs can also be protected by the moving elements such as snap fastener and sliding part and not be visible, since they are directly behind it or behind a plate. The high spring force of the helical spring allows rapid detachment of the heel part from the core part. Rustproof material means that there is no or little wear and no loss of clamping force.

A shoe with the interchangeable heel according to the invention has the same appearance as a shoe with a conventional, non-interchangeable heel. The locking connections or movable elements of the snap-on connections shown can be designed so that they work like a logo, which currently in the footwear industry is often applied to the underside of the shoe body or heel counter.

The heel part with interchangeable shoe heel can be applied to any shoe sole or shoe body like a conventional heel and using the same techniques, such as for example nails, screws or glue.

Advantageous embodiments or configurations of the invention are contained in the other claims.

DESCRIPTION OF THE FIGURES

Exemplary embodiments of the invention and its embodiments or configurations, and further advantages are indicated by the description and the drawing below.

This shows as follows:

FIG. 1 shows a longitudinal section through a shoe body 5*a* (represented in part only), with a heel part 1 attached to it (or to its base). The interchangeable shoe heel comprises the first part 3, of the encasing wall 2, the sleeve 3*a* and the heel tip 4.

Figure 1:
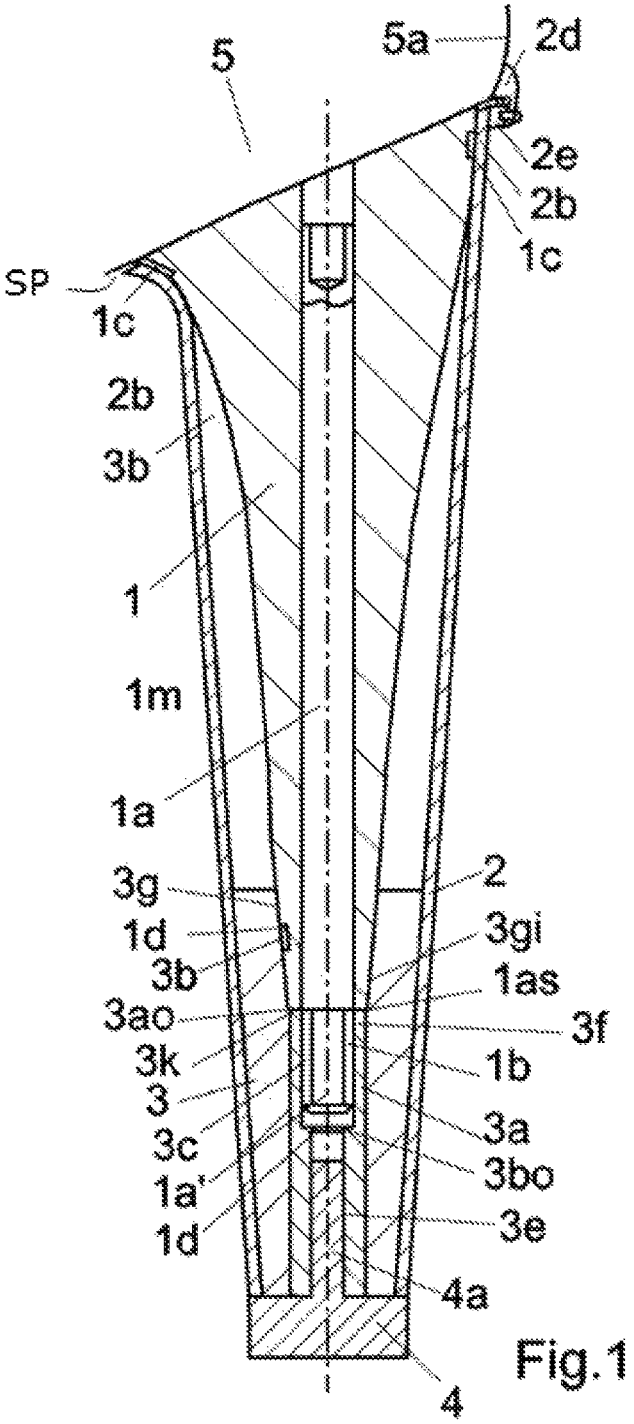
FIG. 1 a longitudinal section through a shoe body with heel part and an interchangeable heel attached thereto.

The heel part 1 can be connected in the conventional manner with the shoe body 5 by means of nailing, gluing, stitching, screwing or similar. The heel part 1 extends over at least half, advantageously at least ⅔ of the entire length or height of the heel. The heel part is extended by the sleeve 3*a* and the heel tip 4. The forces exerted during walking are therefore transmitted via the sleeve 3*a* into the metal rod 1*a* and the heel part 1 into the shoe body 5. The sleeve comprises metal, particularly brass.

The encasing wall 2 is spaced apart from the heel part 1 above the first part 3 and rests merely with its upper end where it adjoins the shoe body 5 on the heel part 1. The narrower the shoe heel and thus the encasing wall 2 is, the smaller is the distance between the encasing wall 2 and the heel part 1. It is also possible for the encasing wall to rest across a large area on the heel part with its inner surface.

The interchangeable shoe heel shown has a medium area. The upper part of the interchangeable shoe heel is therefore hollow. In large area interchangeable shoe heel parts, the hollow space is greater than in narrower heel parts.

A metal rod 1*a* in steel is injection moulded or stuck into the heel part 1, which at the upper end due to the mounting by a screw and above all at the lower end 1*b* is hollow, so that when striking and during storage with the wall 1*d* it does not bend in the sleeve 3*a*. The metal rod 1*a* can also have a hollow configuration over its entire axial length. The sleeve 3*a*, which accommodates the lower end of the metal rod 1*b*, preferably comprises brass. A brass sleeve has a self-lubricating function preventing it jamming with the metal rod 1*a*. The sleeve 3*a* also has a lower recess for the pin 4*a* of the heel tip 4. The sleeve 3*a* can also be made of steel. In this case, the sleeve 3*a* should be filled with silicon to ensure proper lubrication between the parts.

The first part 3 is connected with the encasing wall 2, e.g. by means of sticking or injection moulding and has a recess for the lower end of the heel part 1 and the metal rod 1*a*. The sleeve 3*a* can be injection moulded or stuck into the first part.

Optionally, an anti-twist device 1*d*, 3*d* can be provided between the heel part 1 and the first part 3, which prevents, particularly with large area heels, the parts being twisted against each other during walking.

Figure 1A:
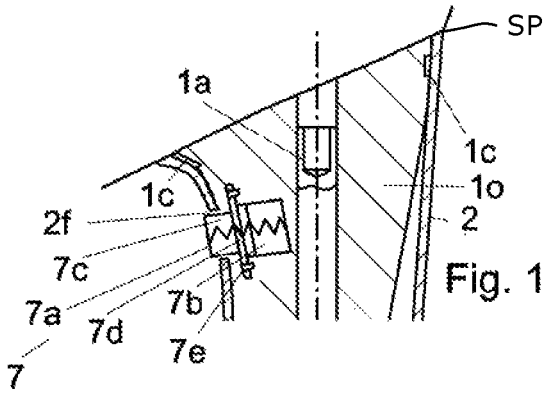
FIG. 1*a* part of the longitudinal section through a shoe body with heel part and snap-on connection with snap fastener on the inside of the inner side of the heel part.
Figure 1B:
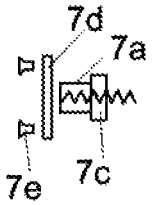
FIG. 1*b* a longitudinal section of the individual parts of the snap-on connection with snap fastener.
Figure 1C:
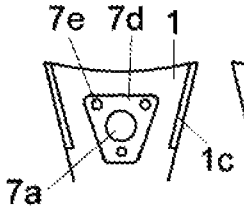
FIG. 1*c* snap-on connection with snap fastener, wherein the connection means are secured to the inner side of the heel part by means of a screwed-on plate.
Figure 1D:
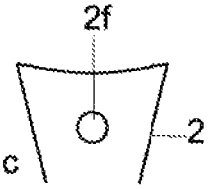
FIG. 1*d* the inner side of the encasing wall with window-like recess for the snap fastener.
Figure 1E:
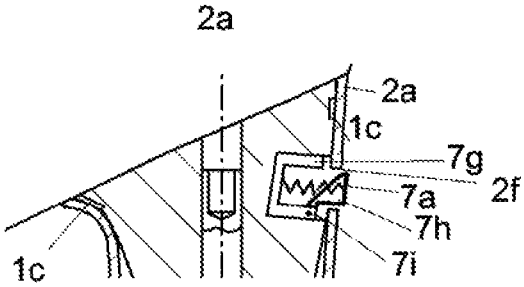
FIG. 1*e* part of the longitudinal section through a shoe body with interchangeable heel with heel part and snap-on connection, having a swivelling element, which is pushed spring-loaded into a window-like recess of the encasing wall.
Figure 1F:
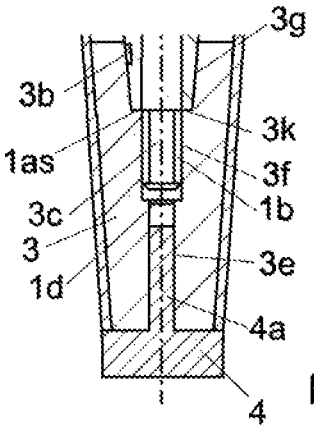
FIG. 1*f* a longitudinal section through a shoe body with interchangeable heel with heel part with first part and recess for the metal rod and heel patch pin.

The metal sleeve 3*a* can, as represented in FIG. 1*f*, be dispensed with if the first part 3 comprises a solid plastic or glass-fibre-reinforced plastic.

The encasing wall 2 has a constant wall thickness and extends from the heel tip 4 upwards to the shoe body 5. Play or gap SP, e.g. of 0.5 mm, may be provided for between the encasing wall 2 and the shoe body 5, so that the encasing wall 2 or the shoe body 5 is not damaged. It is also possible for the sole to be flocked to reduce wear.

As indicated above, the first part 3 and the encasing wall 2 can also have a one-piece configuration.

Through the recess 3*e* in the sleeve 3*a* or first part for the heel pin 4*a*, the heel tip 4 as before can be changed independently or by a shoemaker, if it has become worn.

Since the encasing wall 2 encloses the heel part 1 fully or as far as the sole, this ensures optimum visual and design possibilities as with a conventional non-interchangeable heel. The heel part 1 or upper part of the heel part no longer has to have additional lacquer applied either, with resultant cost savings. The heel part 1 can be made in any desired colour from plastic, irrespective of the colour of the heel or shoe.

The interchangeable heel 2, 3, 4 is held in position and prevented from twisting by 2 guide rods 1*c* of heel part 1. Play between the guide rods should be avoided. Via the guide rods 1*c* a clamping effect of the interchangeable heel part is achieved. This can be achieved in an effective and economical manner with an encasing wall 2 in suitable material having elastic properties and is necessary especially with medium- to large-area heels. With narrow-area heels the form fit also serves to prevent twisting.

The interchangeable shoe heel is connected by means of the locking part 2*d* with the heel counter 5*a* of the shoe body 5. Two possible configurations of the locking part 2*d* are explained in more detail in FIGS. 3-4*c*.

FIG. 1*a* shows a second possible embodiment, the essential structure of which corresponds substantially to FIG. 1, wherein a snap-on connection 7, arranged on the inner side of the heel, connects the interchangeable shoe heel with the heel part 1.

The snap-on connection 7 comprises a snap fastener 7*c*, a plate 7*d*, attached by three screws 7*e* to the heel part 1, and a spring.

The heel part 1 has a recess 7*b* for the spring, which is supported by one end on the floor of the recess 7*b* and by its other end on the inner side of the snap fastener 7*c*. The plate 7*d* has a window-like opening, through which the snap fastener 7*c* protrudes, wherein a collar moulded onto the snap fastener 7*c* prevents complete penetration through the opening. The collar is similarly inset in the recess 7*b*. The plate 7*d* is advantageously made of metal. The snap fastener 7*c* can have a hollow configuration. The part of the snap fastener 7*c*, engaging in the window-like recess 2*f* of the encasing wall 2, can as shown have a square but also round, e.g. spherical or hemispherical, configuration.

The movable round part of the snap fastener 7*c* snaps or engages in a recess 2*f*, adapted to the form and size of the snap fastener 7*c*, and is retained by the spring in the snapped-in position. The shoe heel is removed by pressing on the snap fastener 7*c*, so that this is pushed out of the snapped-in position against the force of the spring 7*a* and no longer engages in the recess 2*f*.

FIG. 1*b* shows the parts of the snap-on connection 7 according to FIG. 1*a*. FIG. 1*c* is shows a longitudinal section in the area of the plate 7*d* through the snap-on connection according to FIG. 1*a*. FIG. 1*c* is shows the encasing wall 2 with its window-like recess 2*f*. The recess 2*f* is located a few centimetres below the sole.

FIG. 1*e* shows a further possible third embodiment, which in terms of the essential structure of the heel corresponds substantially to the embodiment of FIG. 1. The snap-on connection 7 has a housing part 7*g*, which can be inserted in a recess of the heel part 1 and, for example, can be secured there by means of gluing or screws. In the housing part 7*g* a part 7*a* able to swivel about axis 7*i* is supported, which by means of a spring is pushed into the snapped-in position (shown). The snap-on connection can be released by pushing part 7*a* against the spring force through the window-like recess 2*f* of the encasing wall 2 into the housing part 7*g*.

FIG. 1*f* shows a further possible embodiment, which in terms of the essential structure corresponds substantially to FIG. 1, but without the metal sleeve. In this embodiment, the first part 3 is preferably made from high-strength plastic or metal. The first part 3 has an upper first recess 3*g* for engagement of the heel part 1, forming a collar 3*k*, which supports the heel part 1 with its lower support surface 1*as*. Free end 1*b* of the metal rod 1*a* sits with a form fit in a recess 3*f* delimited downwards by the first recess 3*g*. The first part 3 also has a lower recess 3*e* for accommodating the pin 4*a* of the heel tip 4. The first part 3 is fully enclosed by the encasing wall 2, wherein the wall 2 as far as possible is applied and attached with a large, advantageously its full, surface to the first part 3.

Figure 2:
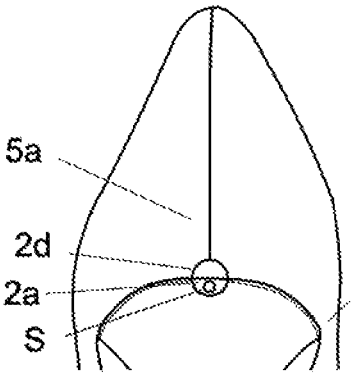
FIG. 2 a view of the shoe body from behind with a locking screw connection with the heel counter of the shoe body and interchangeable shoe heel.

FIG. 2 shows a view of the heel counter 5*a* of the shoe body 5. On the heel counter 5*a*, a connection means 2*a*, 2*d* is arranged with which the encasing wall 2 with its upper edge can be attached to the shoe body 5, 5*a*. Two possible configurations of the connection means are explained in more detail in FIGS. 3-4*c*.

Figure 3:
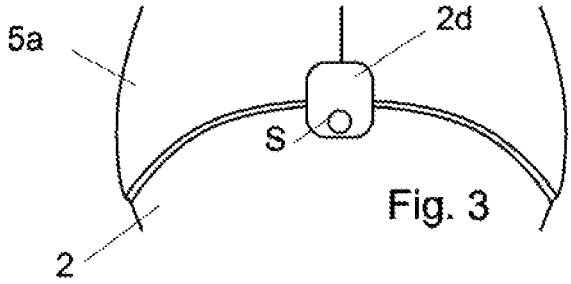
FIG. 3 a view of the lower end of the heel counter of the shoe body with a locking screw connection for connection with the interchangeable shoe heel.

FIG. 3 shows a first possible embodiment of the connection between shoe body and interchangeable shoe heel, as a screw lock.

The first locking part 2*d* is arranged on the lower end of the heel counter 5*a* of the shoe body 5 and the associated locking part 2*e* is arranged on the wall 2. The locking part 2*d* is attached by means of a screw 9 to the heel counter 5*a* and the locking part 2*e* is attached by means of the screw 9 to the wall 2. On the first locking part 2*d* a tab 2*a* is moulded, having a window-like recess for penetration by a screw S. The second locking part 2*e* can have the projection 8*b*, which can serve for form-fitting engagement in the recess 8*c* of the first locking part 2*d*. The second locking part 2*e* also has a recess with internal thread 2*au*, in which the connecting screw S can be screwed for detachable connection of the parts 2*d*, 2*e*, FIG. 3*a* shows the locking parts 2*d*, 2*e* screwed together.

The first locking part 2*d* can be attached with the help of a thin metal plate 12 to the heel counter of the shoe body 5*a* with two screws 9. The heel counter of the shoe body 5*a* can comprise a leather layer 10 with reinforcement 11 and board-like material. If the interchangeable shoe heel does not go completely as far as the sole, there is a small gap 20 between the two locking parts 2*d*, 2*e*.

Figure 3B:
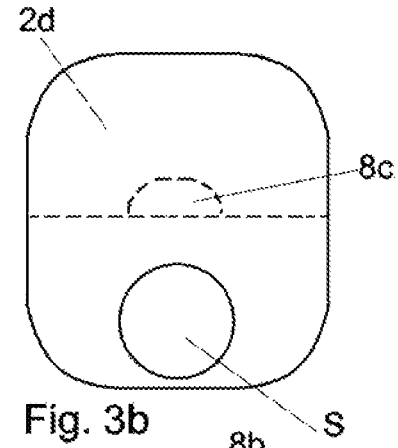
FIG. 3*b* a view of the upper and lower separated part of the locking screw connection according to FIG. 3.
Figure 3A:
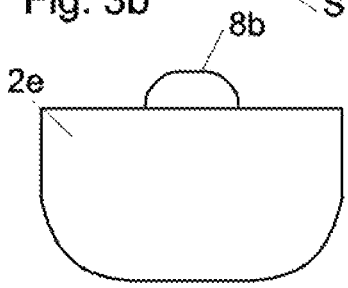
FIG. 3*a* a longitudinal section of the upper and lower part of the locking screw connection according to FIG. 3.
Figure 3A:
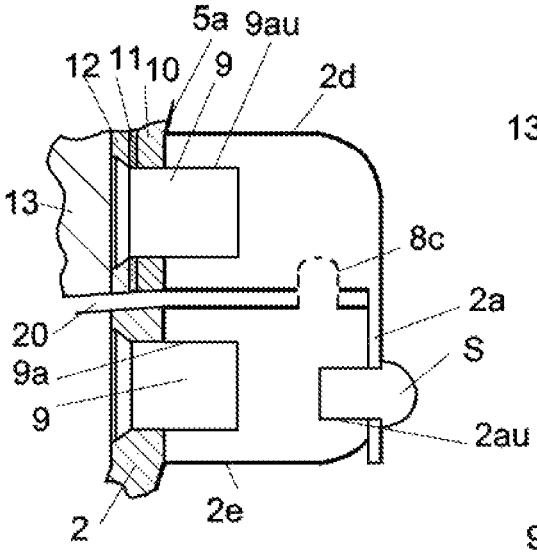

FIG. 3*b* shows an enlarged view of the two locking parts 2*d*, 2*e*. The upper first locking part has a recess 8*c* for the pin 8*b* of the lower locking part 2*e*.

Figure 3C:
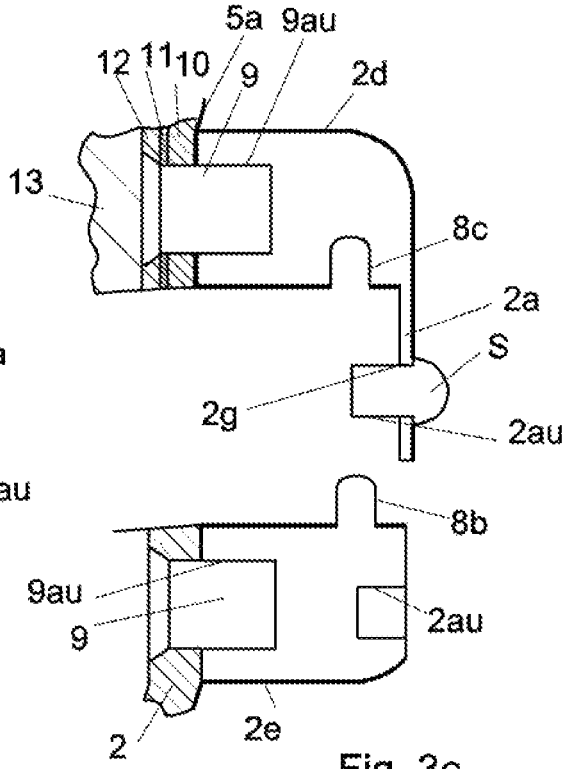
FIG. 3*c* a longitudinal section of the upper and lower part of the opened locking screw connection according to FIG. 3.

FIG. 3*c* shows a view of the unconnected locking parts 2*d*, 2*e*.

Figure 4:
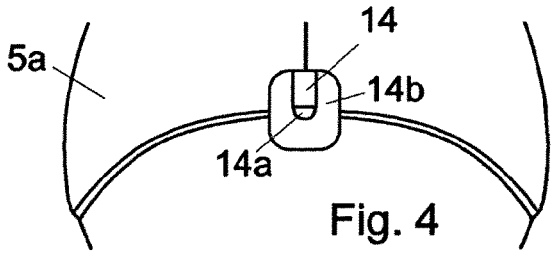
FIG. 4 a view of the lower end of the heel counter of a stirrup lock connection with the interchangeable shoe heel part.

FIG. 4 shows a second possible embodiment of the connection between shoe body 5*a* and interchangeable shoe heel in the form of a stirrup lock.

The locking part 14*b* is positioned on the lower end of the heel counter 5*a* of the shoe body 5 and the associated locking part 14*a* is positioned on the upper end of the encasing wall 2.

Figure 4B:
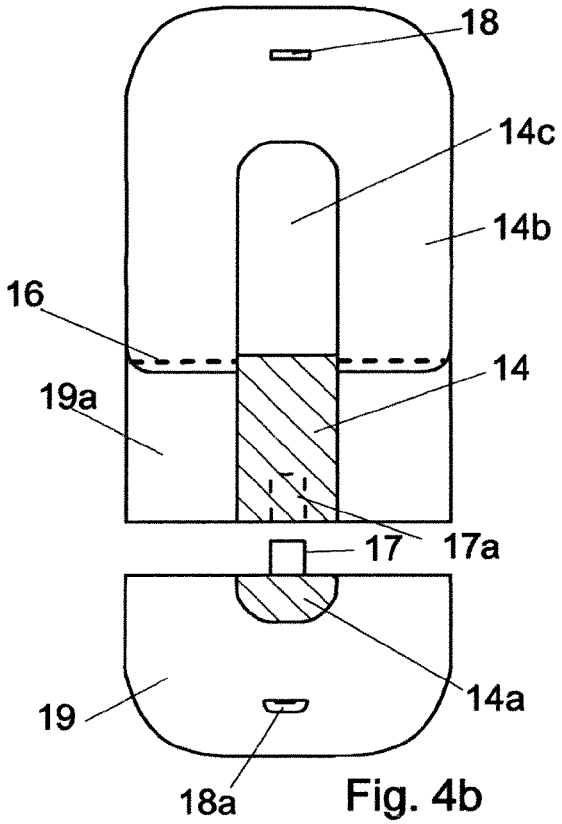
FIG. 4*b* a view of the upper part with cover (stirrup) folded upwards and lower separated part of the stirrup lock connection according to FIG. 4.
Figure 4A:
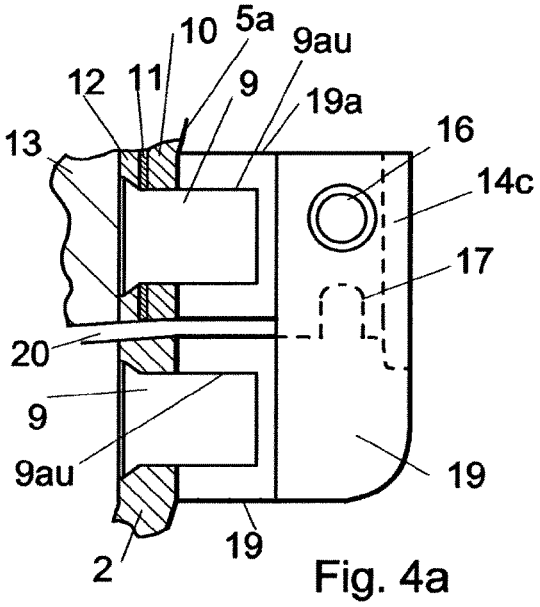
FIG. 4*a* a longitudinal section of the upper and lower part of the stirrup lock connection according to FIG. 4.

FIG. 4*a* shows a longitudinal section of the stirrup lock. The upper locking part, attached to the heel counter 5*a* of the shoe body 5, comprises a base part 19*a* and a stirrup 14*b*, which interacts with the lower locking part 19, which is attached to the encasing wall 2. The connection can be released if the stirrup 14*b* is folded upwards and the pin 17 of the lower locking part 19 releases from the recess for the pin 17 of the upper locking part 19*a*.

The upper locking part 19*a* can be attached using a thin metal plate 12 to the heel counter 5*a* of the shoe body 5 with two screws 9. The heel counter 5*a* of the shoe body 5 can also comprise a leather layer 10 with reinforcement 11 and board-like material. In the upper and lower locking part 19, 19*a* there is a recess 9*au* with thread for mounting the screw on the shoe body 5 and encasing wall 2.

Figure 4C:
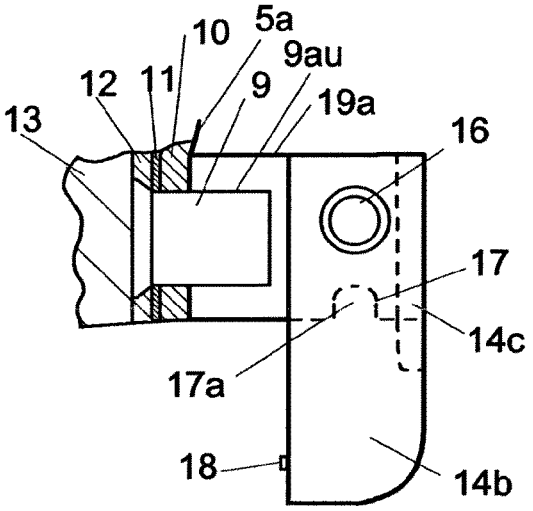
FIG. 4*c* a longitudinal section of the upper and lower part of the open stirrup lock connection according to FIG. 4.
Figure 4C:
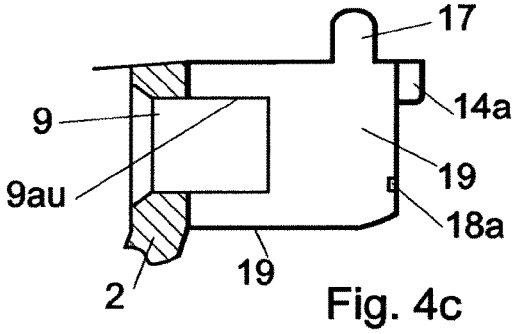

FIG. 4*b* shows an enlarged view of the unconnected locking parts 19*a* and 19. FIG. 4*c* shows an enlarged view of the unconnected locking parts 19 and 19*a*.

In both embodiments shown, the locking parts are for practical purposes arranged on the outside of the heel. The connections in the form of a lock or magnets can be manually released very quickly without tools. They can also be arranged differently, such as for example in the inside of the shoe body, or on the inner side of the heel, although this makes the design and operation, and therefore changing the heel, more difficult.

Further locking connections that can be considered are as follows:

butterfly catch, magnetic catch, clip catch, locking connections with sash fastener, hook closure, Velcro fastener, bikini fastener, bag clasp, case lock, belt clip, S-hook clasp, ring clasp, cable clasp, spring hook clasp or clamping fastener.

LIST OF REFERENCE NUMERALS

1 Heel part, particularly with the heel part firmly attached to the shoe body
1*a* Metal rod
1*a*' Free end of the metal rod
1*as* Support surface of the heel part
1*b* Hollow space of the metal rod
1*c* Guide surface on the top of the core part
1*d* Guide surface on the inner sleeve
1*m* Sleeve surface
1*o* Heel part in the upper area
2 Encasing wall (part of the interchangeable heel)
2*a* Cover of connection part
2*au* Recess for thread
2*b* Guide
S Screw
2*d* Upper connection part
2*e* Lower connection part
2*f* Window-like opening
3 Inner sleeve (part of interchangeable heel)
3*a* Sleeve
3*ao* Supporting surface
3*b* Guide
3*bo* Base wall
3*c* End metal rod
3*e* Sleeve hollow space
3*f* Metal rod recess
3*g* Upper recess
3*gi* Metal rod recess
3*k* Collar
4 Heel tip
4*a* Pin
5 Shoe body
5*a* Heel counter of the shoe body
6 Sole
7 Snap-on connection
7*a* Clamping and engaging part with spring
7*b* Snap-on connection recess
7*c* Snap fastener hollow space
7*d* Metal plate
7*e* Screw
7*g* Housing
7*h* Sliding element hollow space
7*i* Pin recess
8*a* Recess pin
8*b* Pin
9 Upper locking part screw
9*au* Recess for thread
10 Leather
11 Reinforcement leather
12 Metal plate
13 Board-like material
14 Upper locking part with protrusion
14*a* Lower locking part with protrusion
14*b* Stirrup
14*c* Stirrup recess
15 Lower locking part screw
16 Metal pin for hinge
17 Pin
17*a* Pin recess
18 Engaging part
18*a* Bushing
19 Lower locking part
19*a* Upper locking part
20 Gap
SP Gap between the upper face 2*s* of the wall 2 and the shoe body 5, 5*a*

The invention claimed is:

1. An interchangeable shoe heel system, including:
a first shoe heel part configured to be moulded or attached to a shoe body of a shoe, the first shoe heel part including a metal rod extending over at least half of a length of the interchangeable shoe heel system, wherein a free end of the metal rod protrudes from the first shoe heel part; and
an interchangeable second shoe heel part, including:
a first portion having an upper recess into which the free end of the metal rod engages and/or wherein the upper recess engages with some other portion of the first shoe heel part, wherein the upper recess has a support surface in the form of a collar or base wall on an inner wall of the upper recess, which supports the rod or supports a support surface of the first shoe heel part,
a heel tip arranged on a lower end of the first portion, and
an encasing wall, encasing the first portion and connecting to the first portion,
wherein the encasing wall extends from the heel tip up to the shoe body.

2. The interchangeable shoe heel system according to claim 1, wherein the encasing wall includes means to attach the interchangeable second shoe heel part to the first shoe heel part and/or to a shoe body when the first shoe heel part is moulded or attached to the shoe body.

3. The interchangeable shoe heel system according to claim 2, wherein the interchangeable second shoe heel part contains at least one snap-on connection mechanism configured to engage with at least one component of the first shoe heel part.

4. The interchangeable shoe heel system according to claim 3, wherein the at least one portion of the first shoe heel part is in an upper area of the first shoe heel part, which interacts with the encasing wall.

5. The interchangeable shoe heel system according to claim 4, wherein the at least one snap-on connection comprises a spring-loaded engaging or clamping part, in the form of a sphere or hemisphere, which is configured to engage or clamp into a recess of the encasing wall.

6. The interchangeable shoe heel system according to claim 1, wherein the encasing wall of the interchangeable second shoe heel part includes a return configured to form a snap-on connection with at least one projection extending transversally to a longitudinal extension on a sleeve surface of the first shoe heel part.

7. The interchangeable shoe heel system according to claim 1, wherein the encasing wall of the interchangeable second shoe heel part includes an engagement mechanism, located at an upper end of the encasing wall, and configured to form a mechanical connection with a shoe body when the first shoe heel part is moulded or attached to the shoe body.

8. The interchangeable shoe heel system according to claim 7, wherein the engagement mechanism includes a first connection piece, which is attached to a rear end of a shoe body when the first shoe heel part is moulded or attached to the shoe body, wherein a further, second connection piece, which is attached to the encasing wall is configured to be attached to the first connection piece by a snap-on connection or by a screw or a snap-on element.

9. The interchangeable shoe heel system according to claim 1, wherein the first portion is made from brass.

10. The interchangeable shoe heel system according to claim 1, wherein the first portion has a conical form.

11. The interchangeable shoe heel system according to claim 1, wherein the encasing wall has a constant wall thickness.

12. The interchangeable shoe heel system according to claim 1, wherein the first portion comprises at least one guide, extending in a vertical direction, wherein the at least one guide is enabled to interact with guide surfaces arranged on an outer wall of the first shoe heel part and to form or provide anti-twist protection and positioning between the first portion and the first shoe heel part.

13. The interchangeable shoe heel system according to claim 1, wherein the encasing wall comprises at least one guide extending in a vertical direction, wherein the at least one guide is enabled to interact with guide surfaces arranged on an outer wall of the first shoe heel part and to form or provide anti-twist protection and positioning between the encasing wall and the first shoe heel part.

14. The interchangeable shoe heel system according to claim 1, wherein an upper surface of the encasing wall adjoins a shoe body, when the first shoe heel part is moulded or attached to the shoe body, and when the interchangeable second shoe heel part and the first shoe heel part are engaged with each other.

15. The interchangeable shoe heel system according to claim 1, wherein there is a gap between an upper face of the encasing wall and a shoe body, when the first shoe heel part is moulded or attached to the shoe body, and when the interchangeable second shoe heel part and the first shoe heel part are engaged with each other.

16. An interchangeable shoe heel system, including:

a first shoe heel part configured to be moulded or attached to a shoe body of a shoe, the first shoe heel part including a metal rod extending over at least half of a length of the interchangeable shoe heel system, wherein a free end of the metal rod protrudes from the first shoe heel part; and an interchangeable second shoe heel part, including:

a first portion having an upper recess into which the free end of the metal rod engages and/or wherein the upper recess engages with some other portion of the first shoe heel part, wherein the upper recess has a support surface in the form of a collar or base wall on an inner wall of the upper recess, which supports the rod or supports a support surface of the first shoe heel part, a heel tip arranged on a lower end of the first portion, and an encasing wall covering and connecting to the first portion, wherein the encasing wall extends from the heel tip up to the shoe body, and wherein the first portion further includes a metal sleeve, wherein the metal sleeve has an upper face that forms a supporting surface for the support surface of the first shoe heel part, and wherein the sleeve forms the upper recess for the rod.

17. The interchangeable shoe heel system according to claim 16, wherein the free end of the metal rod is enclosed with a form-fit in the metal sleeve.

18. The interchangeable shoe heel system according to claim 16 wherein the heel tip has a projection, which is enabled to be retained in a hollow space of the sleeve or of the first portion using a press fit.

19. A shoe including:

a shoe body;

a heel part that is moulded or attached to the shoe body, wherein the heel part has a metal rod that is connected to the heel part, wherein the rod protrudes with a free end from the heel part; and an interchangeable shoe heel including:

a first part having an upper recess into which the free end of the rod of the heel part of the shoe body engages, and/or the first part engages with some other portion of the heel part of the shoe body, wherein the upper recess has a support surface in the form of a collar or base wall on an inner wall of the upper recess, which supports the rod in an axial direction of the rod or supports a support surface of the heel part, a heel tip arranged on the lower end of the first part, and an encasing wall encasing the first part and connecting to the first part, wherein the encasing wall extends from the heel tip up to the shoe body.

* * * * *